US006723891B1

(12) United States Patent
Wagner et al.

(10) Patent No.: US 6,723,891 B1
(45) Date of Patent: Apr. 20, 2004

(54) MOLYBDATE/PEROXIDE MICROEMULSIONS USEFUL FOR DECONTAMINATION OF CHEMICAL WARFARE AGENTS

(75) Inventors: George W. Wagner, Elkton, MD (US); Lawrence R. Procell, Edgewood, MD (US); Yu-Chu Yang, Bel Air, MD (US); Clifford A. Bunton, Santa Barbara, CA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 70 days.

(21) Appl. No.: 10/213,479

(22) Filed: Aug. 7, 2002

(51) Int. Cl.[7] ..... A62D 3/00
(52) U.S. Cl. ..... 588/200; 510/505

(58) Field of Search ..... 510/365, 505, 510/202, 175; 588/200

(56) References Cited

U.S. PATENT DOCUMENTS

| | | | | | |
|---|---|---|---|---|---|
| 4,134,831 | A | * | 1/1979 | Dawson et al. | 588/232 |
| 5,998,691 | A | * | 12/1999 | Abel et al. | 588/200 |
| 6,245,957 | B1 | * | 6/2001 | Wagner et al. | 588/200 |
| 6,369,288 | B1 | * | 4/2002 | Brown | 588/200 |

* cited by examiner

*Primary Examiner*—Gregory Webb
(74) *Attorney, Agent, or Firm*—Ulysses John Biffoni

(57) ABSTRACT

A process for the decontamination of chemical warfare agents. More particularly, a process for the decontamination of the vesicant HD by oxidation to its corresponding sulfoxide and nerve agents VX and GD by perhydrolysis to their non-toxic phosphonic acids using environmentally safe reactants, specifically a peroxomolybdate compound having a dominant tetraperoxomolybdate species and peroxy anion.

27 Claims, No Drawings

MOLYBDATE/PEROXIDE MICROEMULSIONS USEFUL FOR DECONTAMINATION OF CHEMICAL WARFARE AGENTS

GOVERNMENT INTEREST

The invention described herein may be manufactured, used and licensed by or for the U.S. Government.

BACKGROUND OF THE INVENTION

1. Field of the Invention

The invention relates to decontamination of chemical warfare agents. More particularly, the invention relates to the decontamination of mustard agents such as HD by oxidation, as well as nerve agents such as VX and GD by perhydrolysis, using environmentally safe reactants.

2. Description of the Related Art

Several types of toxic chemical compounds are known to be useful as chemical warfare agents. These include mustard agents or gases known as blister agents, such as bis-(2-chloroethyl)sulfide, also known as HD, and nerve agents such as pinacolyl methylphosphonofluoridate, which is also known as GD, and O-ethyl S-(2-diisopropylamino)ethyl methylphosphonothioate, which is known as VX. HD is a colorless, oily liquid that is highly insoluble in water, and is a powerful vesicant which primarily affects the eyes and the lungs, blisters the skin and is considered a carcinogen. HD is also cytotoxic to hematopoietic tissue and can be lethal at high doses. GD and VX are powerful nerve agents that attack the nerve cells and impair the functioning of the central nervous system.

In order to decontaminate the vesicant mustard gas to render it non-toxic, it is necessary to oxidize it to the corresponding sulfoxide. Nerve agents such as VX and GD are rendered non-toxic by perhydrolysis to their non-toxic phosphonic acids. For example, the oxidation of HD to HD-sulfoxide (HDO) renders the gas non-toxic. One effective way to conduct this oxidation reaction is by reacting the agent with peroxide compounds. Mildly-basic peroxide is also known to effect the perhydrolysis of VX and GD to their non-toxic phosphonic acids. Peroxides are desirable reactants for decontamination because they are non-toxic and non-corrosive, as compared to hypochlorite-based processes which are toxic and environmentally harmful. Additionally, peroxides are preferable because of their extremely low freezing points. However, while it is desirable to decontaminate chemical warfare agents by oxidation in a peroxide system, presently known systems are inefficient decontaminates because they cause secondary oxidation of the corresponding sulfoxide to a sulfone, a toxic vesicant. For example, HD-sulfoxide is a non-vesicant, while HD-sulfone is a highly toxic vesicant material. Also, known peroxide systems using hydrogen carbonate ions as an activator are inefficient because the oxidation reaction is very slow. However, hydrogen carbonate activator is efficient at generating peroxy anion ($OOH^{31}$) for VX and GD perhydrolysis.

Currently, efforts are being undertaken to speed up the oxidation reaction of HD to its sulfoxide, while avoiding the formation of HD sulfone. The rapid, simultaneous perhydrolysis of VX and GD is also desired. Applicants now have discovered a decontamination system that utilizes a peroxide/molybdate reactant system in a water-in-oil microemulsion. The molybdate in the system acts as a peroxide activator by either generating singlet oxygen ($^1O_2$) which diffuses out of the microemulsion and reacts with substrates in a bulk organic solvent, or via generation of peroxomolybdate species of the formula $Mo(O)_x(O—O)_{4-x}^{2-}$, wherein x=0–3. Applicants have further found that when the peroxomolybdate species is present particularly as a tetraperoxomolybdate $Mo(OO)_4^{2-}$dominant species, the decomposition of the peroxide is avoided and $^1O_2$ production is greatly diminished. It has also been found that a tetraperoxo dominant species causes a rapid oxidation of HD to HD-sulfoxide with a rate increase of at least one order of magnitude compared to hydrogen carbonate ion activated systems, while any secondary oxidation of HD-sulfoxide to HD-sulfone occurs at a rate of at least two orders of magnitude slower than a hydrogen carbonate ion activated system. The mild basicity of the molybdate activator further provides for the perhydrolysis of nerve agents VX and GD. The system functions in a variety of microemulsions, exhibits high stability and does not freeze at low temperatures.

SUMMARY OF THE INVENTION

The invention provides a process for decontaminating a chemical warfare agent comprising:

contacting at least one compound having a formula selected from the group consisting of $ROP(O)(CH_3)F$, wherein R is either 2-propyl, pinacolyl, or cyclohexyl;

$R''OP(O)(CH_3)SR'$, wherein R" is ethyl and R' is 2-(diisopropylamino)ethyl; and bis(2-chloroethyl) sulfide, with a peroxomolybdate compound having the formula $Mo(O)_x(O—O)(_{4-x})^{2-}$, wherein x=0–3

The invention also provides a process for decontaminating a chemical warfare agent comprising:

a) forming a peroxomolybdate compound having the formula $Mo(O)_x(O—O)_{(4-x)}^{2-}$, wherein x=0–3 by reacting a peroxide component and a molybdate component; and b) contacting said peroxomolybdate compound with at last one chemical warfare agent having a formula selected from the group consisting of:

$ROP(O)(CH_3)F$, wherein R is either 2-propyl, pinacolyl, or cyclohexyl;

$R''OP(O)(CH_3)SR'$, wherein R" is ethyl and R' is 2-(diisopropylamino)ethyl; and bis(2-chloroethyl) sulfide.

DETAILED DESCRIPTION OF THE PREFERRED EMBODIMENTS

The invention pertains to a process for decontaminating vesicant compounds and nerve agents used as chemical warfare agents. The chemical warfare agents are decontaminated by contacting the agent with a sufficient amount of a peroxomolybdate compound for a sufficient time and under conditions sufficient to produce a non-toxic reaction product. While the present invention is particularly useful for decontamination of mustard gases, it has a broad-spectrum of reactivity toward a variety of chemical warfare agents, even in cold weather operations, while achieving a significant reduction in the toxic, corrosive and environmentally harmful nature of other known decontaminants. The invention is particularly useful for decontaminating vesicant mustard gases. The invention is also useful for decontaminating G and V nerve agents having the following generic formulas: G: $ROP(O)(CH_3)F$, wherein R is either 2-propyl (GB), pinacolyl (GD), or cyclohexyl (GF); V: $R''OP(O)(CH_3)SR'$, wherein R" is ethyl and R' is 2-(diisopropylamino)ethyl (VX). More particularly, the chemical warfare agents decontaminated herein include mustard agent bis(2-chloroethyl) sulfide (HD), and nerve agents pinacolyl methylphosphonofluoridate (GD) and O-ethyl S-[2-(diisopropylamino) ethyl]methylphosphonothioate (VX).

The process includes forming a peroxomolybdate compound having the formula $Mo(O)_x(O—O)_{(4-x)}^{2-}$, wherein x=0–3, in a suitable medium by reacting a peroxide component and a molybdate component in the medium. The preferred medium is a microemulsion which is described below. The peroxide component comprises a material selected from the group consisting of hydrogen peroxide, solid urea hydrogen peroxide, sodium percarbonate peroxide and combinations and derivatives thereof. Of these, the preferred peroxide is a 50% aqueous $H_2O_2$. Solid urea hydrogen peroxide is also particularly applicable to address concerns of storage and handling of concentrated aqueous hydrogen peroxide in the field. Additionally, solid urea hydrogen peroxide is non-toxic and environmentally friendly. The peroxide component is preferably present in the microemulsion at from about 1 to about 25 weight percent, more preferably from about 5 to about 20 weight percent, and most preferably from about 8 to about 15 weight percent.

The molybdate component of the invention is comprised of an alkali metal molybdate. The alkali metal preferably comprises a metal selected from the group consisting of Li, Na, K, Rb, Cs, Fr. More preferably, the alkali metal comprises either lithium (Li), sodium (Na) or potassium (K). Most preferably the molybdate component comprises a molybdate potassium salt, particularly $K_2MoO_4$. The molybdate component is preferably present in the microemulsion at a concentration of from about 0.001 M to about 1.0 M, more preferably from about 0.01 M to about 0.5 M, and most preferably from about 0.1 M to about 0.2 M.

The reaction of the molybdate component and the peroxide component may be further activated with a carbonate and/or bicarbonate activator. These latter activators work to enhance the perhydrolysis of nerve agents VX and GD to their corresponding phosphonic acids. The carbonate and/or bicarbonate activator is preferably selected from the group consisting of sodium bicarbonate, sodium carbonate, potassium bicarbonate, potassium carbonate, lithium bicarbonate, lithium carbonate, ammonium bicarbonate, ammonium carbonate, hydrogen carbonate, hydrogen bicarbonate, ammonium hydrogen carbonate and combinations thereof. More preferably, the carbonate and/or bicarbonate activator comprises potassium bicarbonate or potassium carbonate. The carbonate and/or bicarbonate activator preferably is present in the microemulsion in an amount of from about 0.01 M to about 2.0 M, more preferably from about 0.1 M to about 1.0 M, and most preferably from about 0.2 M to about 0.8 M.

The reaction of the peroxide component and the molybdate component forms peroxomolybdate compounds in the microemulsion which have the formula $Mo(O)_x(O—O)_{(4-x)}^{2-}$, wherein x=0–3.The result is a microemulsion that may have four distinct peroxomolybdate species therein, which species comprise monoperoxomolybdate, $Mo(O)_3(O—O)^{2-}$, diperoxomolybdate, $Mo(O)_2(O—O)_2^{2-}$, triperoxomolybdate, $Mo(O)(O—O)_3^{2-}$, and tetraperoxomolybdate, $Mo(O—O)_4^{2-}$. Of these, it has been found that the oxidation of the vesicants to their corresponding non-vesicant sulfoxides is most effective when the dominant peroxomolybdate species comprises the tetraperoxomolybdate species, which is the most active and most stable species. In order for this species to dominate, there must be a high concentration of peroxide in the microemulsion. In the preferred embodiment of the invention, the ratio of hydrogen peroxide to molybdate preferably ranges from about 3.0 to about 3.5,more preferably from about 3.5 to about 4.0,and most preferably the ratio is greater than about 4.0.The preferred result is a microemulsion including less than 10% of each the monoperoxomolybdate, diperoxomolybdate and triperoxomolybdate species, and from about 90% to about 100% of the tetraperoxomolybdate species.

In use, the peroxomolybdate compound may be applied in the form of a spray, a vapor, a liquid, a solid, and/or other physical forms of mixtures that incorporate the peroxide and molybdate components of the decontaminant. Preferably the peroxomolybdate compound is present as a liquid or as a spray. For the peroxomolybdate compound to be applied in a liquid form, it is necessary to disperse the compound in a suitable medium. In one preferred embodiment of the invention, the peroxomolybdate compound is dispersed in a water-oil microemulsion. In this embodiment, the oil preferably comprises either hexane or methylene chloride. Of these, hexane is preferred.

In general, a microemulsion is a transparent or translucent, thermodynamically stable, isotropic dispersion of two immiscible liquids with microdomains of one or both liquids stabilized by an interfacial film of surface-active molecules. It typically comprises water, at least one organic solvent (oil), at least one surfactant, and in most cases at least one co-solvent. The water-in-oil microemulsions are roughly spherical water microdroplets coated by an interfacial film of a surfactant, e.g. sodium dodecyl sulfate (SDS), and a co-solvent, e.g. butanol (BuOH), and dispersed in a continuous phase of oil, e.g. hexane. Other suitable surfactants non-exclusively include cetyl trimethylammonium chloride (CTAC), and polyoxyethylene ethers, such as polyoxyethylene(10) isooctylphenyl ether (Triton X-100). Of these, polyoxyethylene ethers are preferred. Other suitable co-solvents non-exclusively include 2-propanol, 2-methyl-1-propanol and propylene carbonate. Of these propylene carbonate is preferred. The microemulsion may also further include at least one carbonate and/or bicarbonate activator as described above. The molybdate component (e.g. $K_2MoO_4$) and the peroxide component (e.g. $H_2O_2$) are dissolved within the microemulsion to form the desired peroxomolybdate compounds. The hydrogen peroxide is generally added in batches to the medium. It generates $^1O_2$,but also some water as a side product derived both from the disproportionation and from the water of dilution of hydrogen peroxide.

The microemulsion should ideally be designed to meet three requirements: no phase separation during storage and during the oxidation reaction, high solubility of the reactants (e.g. peroxide and molybdate components), and simple recovery of the oxidized product, surfactant, and catalyst (molybdate compound) at the end of the reaction. Furthermore, none of the components of the microemulsion itself should react with the peroxide, molybdate or the intermediates derived therefrom (peroxomolybdates and singlet oxygen). In an alternate embodiment, the peroxomolybdate compound may be dispersed in a water-surfactant medium. The water-surfactant medium may include any of the surfactants described above, and may further include one or more co-solvents from the list described above.

In the preferred embodiment of the invention, the microemulsion exhibits stability at a temperature of from about −30° C. to about −40° C., more preferably from about −40° C. to about −45° C., and most preferably from about −45° C. to about −50° C. Additionally, the microemulsion is preferably maintained at a pH of from about 7 to about 12, more preferably from about 7.5 to about 11, and most preferably from about 8 to about 10.

Once the peroxomolybdate compound is formed and blended with a suitable medium, the compound is contacted with at least one chemical warfare agent having a formula described above. The contact may be accomplished by immersing a chemical warfare agent covered article into a solution containing the described peroxomolybdate species, spraying the peroxomolybdate compound onto an article, or other means for reacting the peroxomolybdate with the chemical warfare agent. The agent is contacted with the peroxomolybdate compound for a time and under conditions sufficient to oxidize the agent into a non-toxic oxide. For example, when the blister agent mustard gas (HD), bis(2-chloroethyl)sulfide, is contacted with a peroxomolybdate compound of the invention, it is oxidized to its corresponding sulfoxide according to the reaction below:

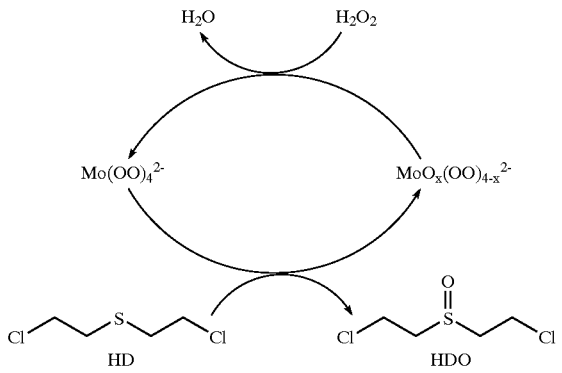

wherein x=0–3. While this reaction occurs quite rapidly, some secondary oxidation to the corresponding sulfone does occur, but this reaction occurs at about two orders of magnitude slower than the initial reaction. The amounts, conditions and time required to achieve the desired result will, of course, vary somewhat based upon the type and amount of agent present and the area to be treated.

The following non-limiting examples serve to illustrate the invention.

EXAMPLE $K_2MoO_4$, n-BuOH, $CH_2Cl_2$, sodium dodecyl sulfate (SDS), Triton X-100, i-PrOH, hexane, and 50% aqueous $H_2O_2$ were all obtained. Microemulsions (MEs)were mixed by first adding the solid ingredients (e.g., SDS and/or $K_2MoO_4$), followed by co-surfactant (e.g., n-BuOH or i-PrOH), surfactant, organic solvent, and finally 50% $H_2O_2$ to a 3 ml vial. The vial was capped and vortex mixed briefly. The microemulsions spontaneously formed and generation of $Mo(OO)_4^{2-}$ was immediately apparent from the amber color of the potassium salt of this species. Reactions were initiated by adding neat liquid HD (9 $\mu$L), GD (1.4 $\mu$L) or VX (2 $\mu$L) to 0.75 mL of the decon solution contained in a 5 mm NMR tube. The concentrations of HD, GD and VX were 0.1, 0.01 and 0.01 M, respectively. The tube was capped and shaken to assure complete dissolution of the agents. Reactions were monitored by $^1$H (HD) or $^{31}$P (GD, VX) NMR by using Varian Unityplus 300 or Inova 400 NMR spectrometers to obtain kinetic data. A reaction was performed at −30° C. by precooling the decon solution in the 5 mm NMR tube in the NMR spectrometer. The tube was removed and room temperature HD was added and thoroughly mixed (this process took about 2 min). The tube was then quickly returned to the −30° C. spectrometer to monitor the reaction.

Half-lives observed for the reaction of HD in various microemulsions (MEs) are shown in Table 1. Although this work mainly targeted HD oxidation, Table 1 also shows MEs tested against VX and GD. For HD reactions, the concentration of $K_2MoO_4$ in each ME was 0.01 M, which was low enough in most cases to allow measurements of the half-lives. Higher concentrations would have rendered the reactions essentially instantaneous. Also, 0.1 to 0.2 M hydrogen carbonate activator (ten to twenty times the concentration of molybdate ion) would be required to achieve similar half-lives. Thus as a peroxide activator for HD oxidation, molybdate ion is at least an order of magnitude more powerful than hydrogen carbonate ion.

Water-in-oil (w/o) microemulsions #1–4 were formed containing the constituents typical of such ME's: SDS (surfactant), n-BuOH (cosurfactant), $CH_2Cl_2$ (oil phase), and 50% $H_2O_2$ (aqueous phase). Although HD dissolution and oxidation proceeded well in these ME's, they contain toxic $CH_2Cl_2$ and are thus environmentally unacceptable. Additional ME's were formulated using more environmentally friendly ingredients, which also yielded good HD dissolution/reaction. For example ME #5,composed of Triton X-100 (surfactant), i-PrOH (cosurfactant), hexane (oil phase) and 50% $H_2O_2$ (aqueous phase), rapidly dissolved and oxidized HD with a half-life too fast to measure by NMR (t½<30 see).

As a further step to meet "Green" criteria and to minimize the number of necessary components, an additional series of microemulsions were examined by using only Triton X-100, i-PrOH and aqueous 50% $H_2O_2$. The resulting solutions are not true oil-in-water MEs as these streamlined mixtures lack a conventional oil phase and can be regarded as modified micelles. However, HD is readily dissolved; and thus briefly becomes the "oil phase" prior to reacting in these ME's. It is important to note that compared to the toxic series of MEs #1–4, no loss in HD reactivity is observed using the "Green" ingredients of MEs #6–8. Indeed, the reaction in ME #6 is about twice as fast as in the conventional microemulsions due to a decrease in the oil-phase volume. For ME #7, increasing the $H_2O_2$ and $K_2MoO_4$ concentrations renders the reaction too fast to measure. In ME #8, the secondary oxidation of HDO to $HDO_2$ was monitored by $^1$H and $^{13}$C NMR, with a half-life of 96.5 min. Thus the undesired secondary oxidation of HDO is at least two orders of magnitude slower than primary oxidation of HD.

These Green MEs were also found suitable for low temperature decontamination of HD. ME #8 exhibited no phase separation, precipitation or freezing down to at least −45° C. Furthermore, room temperature HD added to ME #8 at −30° C. readily dissolved and was oxidized with a half-life of 5.7 min at −30° C. Although we could not observe whether HD actually froze prior to its dissolution, the fact that it dissolved and remained in solution strongly suggests that the ME would dissolve frozen HD.

An attempt at using ME #8 ([$K_2MoO_4$]=0.01 M) to decontaminate GD resulted in a half-life of 2.9 h. To enable use of higher concentrations of molybdate, the amount of peroxide was increased as shown in ME #9. ME #9 ([$K_2MoO_4$]=0.1 M) which reduced the GD half-life to a more acceptable 1.43 min, was also nearly as effective against VX, which exhibited a half-life of 3.2 min. For ME #10 the molybdate concentration was 0.2 M, which was close to the saturation point, and this resulted in a VX half-life of 2.5 min.

Although molybdate/hydrogen peroxide is a broad-spectrum decontaminant for HD, GD and VX, the HD reaction is orders of magnitude faster than those of GD and VX. Reaction of GB involves nucleophilic attack by $OOH^-$ which also reacts rapidly with VX, however tetraperoxomolybdate could behave like a peroxyacid in oxidatively hydrolyzing VX. At the molybdate concentration needed for fast reaction of VX, the HD reaction would result in the nearly instantaneous formation of vesicant sulfone. However, as a peroxide activator for CW decontamination, the molybdate behavior is complementary to hydrogen carbonate where VX and GD react nearly instantaneously, and HD is much slower. Thus used in combination, suitable proportions of molybdate and bicarbonate would effect rapid reactions for all three agents, and avoid undue $HDO_2$ formation.

TABLE 1

Half-Lives Observed for HD, VX and GD in Microemulsions

| ME | $K_2MoO_4$ | Surfactant | Cosurfactant | Oil Phase | 50% $H_2O_2$ | Agent | t½ |
|---|---|---|---|---|---|---|---|
| | | SDS[a] | n-BuOH[a] | $CH_2C_{12}$[a] | | | |
| 1 | 2.4 mg[b] | 99 mg | 0.198 g | 0.403 g | 0.354 g | HD[c] | 1.0 min |
| 2 | 2.4 mg | 96 mg | 0.193 g | 0.501 g | 0.248 g | HD | 1.4 min |
| 3 | 2.4 mg | 86 mg | 0.173 g | 0.602 g | 0.165 g | HD | 1.8 min |
| 4 | 2.4 mg | 76 mg | 0.146 g | 0.698 g | 0.098 g | HD | 1.2 min |
| | | Triton X-100 | i-PrOH | Hexane | | | |
| 5 | 2.5 mg | 0.214 g | 0.395 g | 0.0786 g | 0.300 g | HD | <30 sec |
| | | Triton X-100 | i-PrOH | | | | |
| 6 | 2.4 mg | 0.214 g | 0.471 g | | 0.236 g | HD | 39 sec |
| 7 | 3.6 mg[d] | 0.214 g | 0.432 g | | 0.295 g | HD | <30 sec |
| 8 | 2.4 mg | 0.214 g | 0.432 g | | 0.295 g | HD | 32 sec[e] |
| 8 | 2.4 mg | 0.214 g | 0.432 g | | 0.295 g | HD | 5.7 min (−30° C.) |
| 8 | 2.4 mg | 0.214 g | 0.432 g | | 0.295 g | GD[f] | 2.9 h |
| 9 | 24 mg[g] | 0.214 g | 0.236 g | | 0.590 g | GD | 1.43 min |
| 9 | 24 mg[g] | 0.214 g | 0.236 g | | 0.590 g | VX[f] | 3.2 min |
| 10 | 48 mg[h] | 0.214 g | 0.236 g | | 0.590 g | VX[f] | 2.5 min |

[a]Adapted from Aubry and Bouttemy; "Preparative Oxidation of Organic Compounds in Microemulsions with Singlet Oxygen Generated Chemically by the Sodium Molybdate/Hydrogen Peroxide System" J. Am. Chem. Soc. 1997, 119, 5286–5294.
[b]$[K_2MoO_4]$ = 0.01M.
[c][HD] = 0.1M.
[d]$[K_2MoO_4]$ = 0.015M.
[e]t½ = 96.5 min for HDO→HDO2.
[f]0.01M.
[g]$[K_2MoO_4]$ = 0.1M.
[h]$[K_2MoO_4]$ = 0.2M.

As a peroxide activator, molybdate ion affords at least an order of magnitude increase in the rate of HD oxidation compared to hydrogen carbonate ion, rendering the reaction nearly instantaneous. Secondary oxidation to the sulfone does occur, but this reaction is slower by at least two orders of magnitude. The molybdate/peroxide reactive system functions in a variety of microemulsions, including those composed of non-toxic ingredients. These latter formulations exhibited stability and did not freeze at extremely low temperatures (<−45° C.) and readily dissolved HD which freezes at 14° C. Thus such microemulsions in which tetraperoxomolybdate is the major peroxo species would be suitable for decontamination of HD and other toxic sulfides in both temperate and cold environments. Molybdate/peroxide is also effective against GD and VX, but the molybdate/hydrogen peroxide concentrations necessary for fast reactions would result in facile $HDO_2$ formation. However, combinations of molybdate and hydrogen carbonate ions would provide fast reactions for all three agents.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A process for decontaminating a chemical warfare agent comprising:

contacting at least one compound having a formula selected from the group consisting of $ROP(O)(CH_3)F$, wherein R is either 2-propyl, pinacolyl, or cyclohexyl;

$R''OP(O)(CH_3)SR'$, wherein R" is ethyl and R' is 2-(diisopropylamino)ethyl; and bis(2-chloroethyl) sulfide, with a peroxomolybdate compound having the formula $Mo(O)_x(O—O)_{(4-x)}^{2-}$, wherein x=0–3.

2. A process for decontaminating a chemical warfare agent comprising:

a) forming a peroxomolybdate compound having the formula $Mo(O)_x(O—O)_{(4}-x)^{2-}$, wherein x=0–3 by reacting a peroxide component and a molybdate component; and b) contacting said peroxomolybdate compound with at last one chemical warfare agent having a formula selected from the group consisting of:

$ROP(O)(CH_3)F$, wherein R is either 2-propyl, pinacolyl, or cyclohexyl;

$R''OP(O)(CH_3)SR'$, wherein R" is ethyl and R' is 2-(diisopropylamino)ethyl; and bis(2-chloroethyl) sulfide.

3. The process of claim 2 wherein the molybdate component comprises an alkali metal molybdate.

4. The process of claim 3 wherein the alkali metal comprises a metal selected from the group consisting of Li, Na, K, Rb, Cs, Fr.

5. The process of claim 2 wherein the molybdate component comprises a molybdate potassium salt.

6. The process of claim 1 wherein the peroxomolybdate compound is present in a water/oil microemulsion.

7. The process of claim 6 wherein the oil is selected from the group consisting of methylene chloride and hexane.

8. The process of claim 6 wherein the oil comprises hexane.

9. The process of claim 1 wherein the peroxomolybdate compound is present in a water-surfactant mixture.

10. The process of claim 9 wherein said surfactant comprises at least one material selected from the group consisting of sodium dodecyl sulfate, cetyl trimethylammonium chloride and polyoxyethylene ethers.

11. The process of claim 9 wherein said surfactant comprises polyoxyethylene(10) isooctylphenyl ether.

12. The process of claim 9 wherein said water-surfactant mixture further comprises at least one co-solvent.

13. The process of claim 12 wherein said co-solvent comprises a material selected from the group consisting of 2-propanol, 2-butanol, 2-methyl-1-propanol and propylcne carbonate.

14. The process of claim 1 wherein the peroxomolybdate compound has the formula $Mo(O)_3(O—O)^{2-}$.

15. The process of claim 1 wherein the peroxomolybdate compound has the formula $Mo(O)_2(O—O)_2^{2-}$.

16. The process of claim 1 wherein the peroxomolybdate compound has the formula $Mo(O)(O—O)_3^{2-}$.

17. The process of claim 1 wherein the peroxomolybdale compound has the formula $Mo(O—O)_4^{2-}$.

18. The process of claim 2 wherein the molybdate component has the formula $K_2MoO_4$.

19. The process of claim 1 wherein the chemical warfare agent comprises bis(2-chloroethyl)sulfide.

20. The process of claim 1 wherein the chemical warfare agent comprises pinacolyl methylphosphonofluoridate.

21. The process of claim 1 wherein the chemical warfare agent comprises O-ethyl S-[2-(diisopropylamino)ethyl] methylphosphonothioate.

22. The process of claim 2 wherein the peroxide component comprises a material selected from the group consisting of hydrogen peroxide, solid urea hydrogen peroxide, sodium percarbonate peroxide and combinations and derivatives thereof.

23. The process of claim 2 wherein the peroxide component comprises 50% aqueous hydrogen peroxide and derivatives thereof.

24. The process of claim 2 further comprising activating the reaction between the peroxide component and the molybdate component with a carbonate and/or bicarbonate activator.

25. The process of claim 24 wherein the activator is selected from the group consisting of sodium bicarbonate, sodium carbonate, potassium bicarbonate, potassium carbonate, lithium bicarbonate, lithium carbonate, ammonium bicarbonate, ammonium carbonate, hydrogen carbonate, hydrogen bicarbonate and combinations thereof.

26. The process of claim 24 wherein the activator comprises potassium bicarbonate.

27. The process of claim 24 wherein the activator comprises potassium carbonate.

* * * * *